United States Patent [19]

Brauner

[11] 4,428,525

[45] Jan. 31, 1984

[54] EASY ACCESS SANDWICH CARTON

[75] Inventor: Arne H. Brauner, Peekskill, N.Y.

[73] Assignee: International Paper Company, New York, N.Y.

[21] Appl. No.: 406,748

[22] Filed: Aug. 9, 1982

[51] Int. Cl.[3] ..... B65D 5/36; B65D 5/24

[52] U.S. Cl. ..... 229/41 R; 229/41 B; 229/31 R

[58] Field of Search ..... 229/41 R, 41 B, 31 R, 229/34 B

[56] References Cited

U.S. PATENT DOCUMENTS

| | | | |
|---|---|---|---|
| 723,830 | 3/1903 | Claxton | 229/33 |
| 1,985,990 | 1/1935 | Hanson | 229/41 |
| 2,160,643 | 5/1939 | Burel | 229/32 |
| 2,177,993 | 10/1939 | Olsen | 229/52 |
| 2,221,368 | 11/1940 | Buser | 229/41 B |
| 2,316,362 | 4/1943 | Poe | 229/45 |
| 2,551,324 | 5/1951 | Frieders et al. | 229/36 |
| 2,572,159 | 10/1951 | Kells et al. | 229/45 |
| 2,652,969 | 9/1953 | Pfaff | 229/33 |
| 2,708,065 | 5/1955 | Inman | 229/33 |
| 2,878,987 | 3/1959 | Inman | 229/41 B |
| 2,925,212 | 2/1960 | Welsh, Jr. | 229/36 |
| 2,982,465 | 5/1961 | Fallert | 229/36 |
| 3,095,136 | 6/1963 | Conescu | 229/41 B |
| 3,185,378 | 5/1965 | Rosenburg | 229/41 R |
| 3,827,624 | 8/1974 | Dogliotti | 229/45 |
| 3,904,106 | 9/1975 | Elder | 229/31 R |

*Primary Examiner*—Herbert F. Ross

*Attorney, Agent, or Firm*—Royal E. Bright

[57] ABSTRACT

A carton having upper and lower hingedly connected halves with "V" shaped cross sections, adapted to be folded compactly and firmly closeable when erected and filled with contents are disclosed. The cartons are especially suitable for use in packaging fast food items particularly hot or cold sandwiches on rolls or buns.

1 Claim, 6 Drawing Figures

EASY ACCESS SANDWICH CARTON

BACKGROUND OF THE INVENTION

The present invention relates to folding cartons formed from paperboard and similar semi-rigid materials which may be folded compactly for storage and shipping and then may be easily erected, filled with contents and temporarily relatively securely closed and which are particularly suitable for packaging edible items such as hot or cold sandwiches prepared on rolls or buns.

DISCLOSURE OF ART

Applicant is aware of the following U.S. patents which might be considered relevant to applicant's invention.

U.S. Pat. No. 723,830 illustrating a rectangular box with attached cover which folds flat when not in use.

U.S. Pat. No. 1,985,980 illustrating a rectangular lunch box having an attached cover and separable compartment for holding a vacuum bottle which folds flat when not in use.

U.S. Pat. No. 2,160,643 illustrating a rectangular folding box with attached lid wherein the corner flaps are only partially glued to the side walls in a fashion permitting them to remain without a fold line when the carton is folded for storage. This feature is stated as being a reinforcement enabling the box to better resist collapse when erected.

U.S. Pat. No. 2,177,993 is primarily directed to carrier handles for cartons but incidentally illustrates a closure flap having a reverse tab (26) and cooperating slot (28) assisting in providing a relatively secure temporary closure in addition to the friction tab (27) and cooperating slot (23) also provided for closure.

U.S. Pat. No. 2,316,362 also illustrating the use of reverse tabs in securing two parts of a two piece rectangular carton together.

U.S. Pat. No. 2,551,324 illustrating a rectangular box with attached cover wherein the flaps attached to side walls to form corners are partially secured so that when the box is folded, the flaps are not creased with a fold line and assist in strengthening the box vertically when it is erected.

U.S. Pat. No. 2,572,159 illustrating various tuck end fiberboard boxes. One embodiment thereof shows a reverse tab and cooperating slot to assist the closure.

U.S. Pat. No. 2,652,969 illustrating a rectangular folding carton where certain of the corner tabs are again only partially secured to side walls so that they do not need to be scored for folding and assist in supplying vertical support to the erected carton.

U.S. Pat. No. 2,708,065 illustrating another collapsible carton.

U.S. Pat. No. 2,925,212 illustrating a reverse tab employed to assist the closure of the particular carton shown.

U.S. Pat. No. 2,982,465 also illustrating a rectangular box having corner flaps partially attached to side walls so that they are not creased by a fold line when the box is folded.

U.S. Pat. No. 3,827,624 illustrating another version of a reverse tab closure for a rectangular carton.

The present invention provides a carton having a different configuration and significant use difference over those shown in the prior art.

SUMMARY OF THE INVENTION

The invention provides a folding carton consisting of (A) a lower portion having a substantially "V" shaped cross section comprising a bottom wall, a rear wall hingedly attached thereto, and two lower side walls hingedly attached to said bottom and rear walls; each of said side walls comprising an inner lower flap hingedly attached to said bottom wall and an outer lower flap hingedly attached to said rear wall, said outer lower flap being divided into substantially equal glue and non-glue panels by a fold line extending upwardly from the intersection of said outer lower flap and said bottom and rear walls, said glue panel being the panel relatively more remote from the line of attachment of said outer lower flap to said rear wall and said outer lower flap being secured to said inner lower flap only at said glue panel; said inner lower flap bearing a tab adapted to be cooperatively engaged in a slit sited about at the fold line connecting said rear wall and said outer lower flap; and (B) an upper portion having a substantially "V" shaped cross section, hingedly attached to said lower portion, comprising a top wall, a front wall hingedly attached thereto and two upper side wall portions hingedly attached to said front and top wall, each of said upper side wall portions comprising an inner upper flap hingedly attached to said front wall and an outer upper flap hingedly attached to said top wall, said outer upper flap being divided into substantially equal glue and non-glue panels by a fold line extending downwardly from the intersection of said outer upper flap and said top and front walls, said glue panel being the panel relatively more remote from the line of attachment of said outer upper flap to said top wall and said outer upper flap being secured to said inner upper flap only at said glue panel; said lower side walls extending partially inside said upper side walls in the erected and closed carton; said bottom wall having a flap extending therefrom on the front edge thereof said flap having a "U" shaped slit therein adapted to form a reverse tab cooperatively engageable in a corresponding slit in said front wall.

The tangible embodiments of this aspect of the invention possess the inherent applied use characteristics of being readily assemblable and compactly folded for storage and shipping by hand or by automatic or semi-automatic machinery, of being easily erected, when erected of presenting a wide opening for easy filling and after insertion of desired contents of being readily closeable to provide a firm temporary closure with minimal manual manipulation.

The invention also provides a blank assemblable to form the carton aspect of the invention.

DESCRIPTION OF THE PREFERRED EMBODIMENT

Figure 1:
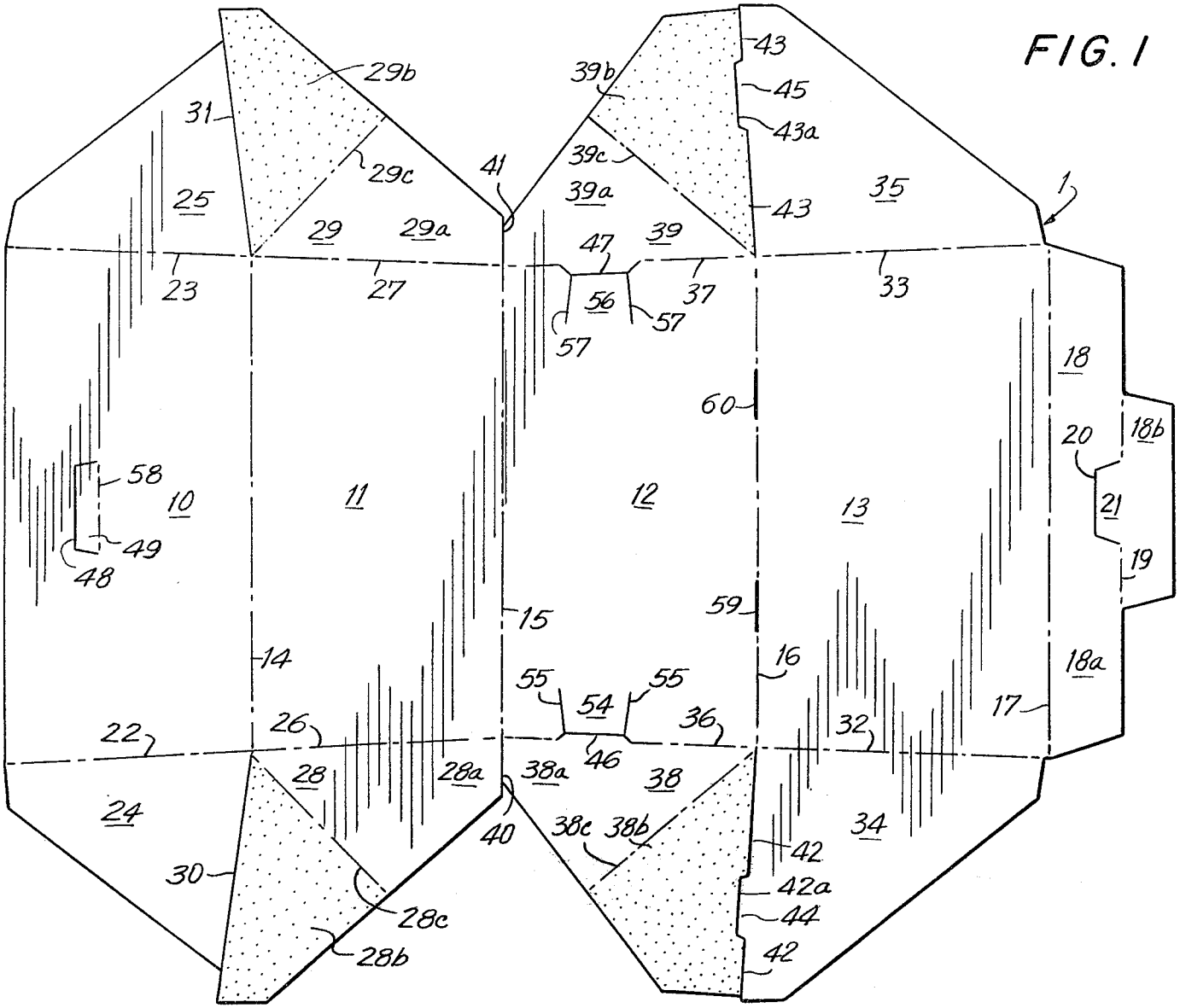
FIG. 1 is a plan view of a blank for a carton of the invention.
Figure 2:
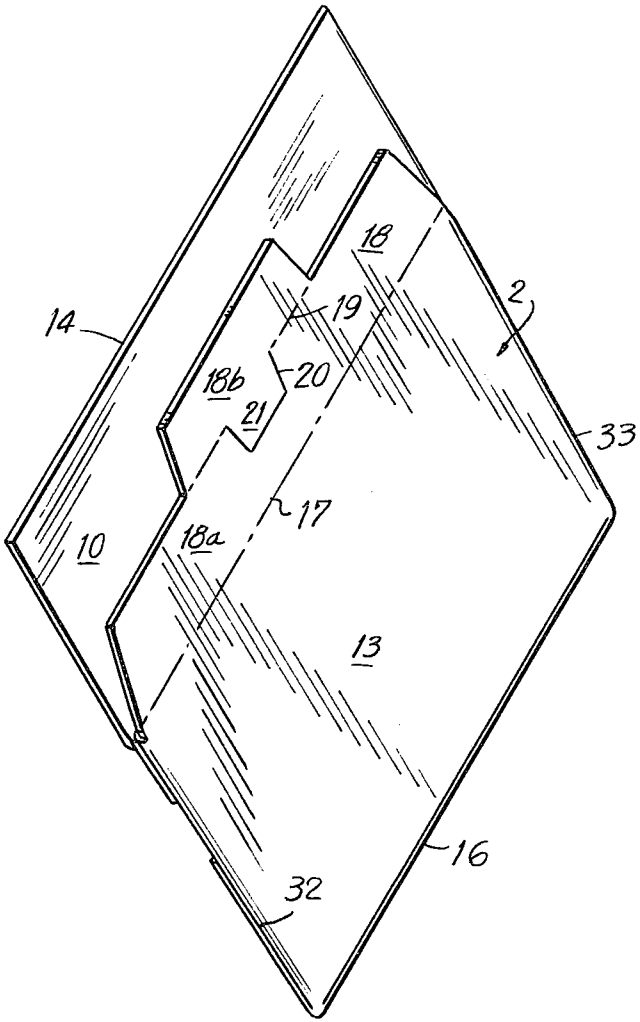
FIG. 2 is a perspective view of a carton of the invention assembled from the blank of FIG. 1 and folded flat for shipping and storage.

The manner of making and using a carton of the invention will now be described with reference to the drawings. Turning now to the drawings, there is shown blank 1 comprising front wall 10, top wall 11, rear wall 12, and bottom wall 13 foldably connected to one another by score lines 14, 15, and 16, respectively. Hingedly attached to bottom wall 13 by score line 17 is closure flap 18 which is divided into major panel 18*a* and minor panel 18*b* by score line 19 and "U" shaped slit 20. Slit 20 also defines reverse tab 21 as part of panel 18*b*. Hingedly attached to front wall 10 by score lines 22 and 23 are inner upper flaps 24 and 25, respectively. Hingedly attached to top wall 11 by score lines 26 and 27 are outer upper flaps 28 and 29, respectively. Flaps 28 and 29 are separated into two substantially equal panels 28*a* and 28*b* and 29*a* and 29*b* by score lines 28*c* and 29*c*, respectively. Flaps 28 and 29 are separated froms flaps 24 and 25 by slits 30 and 31, respectively. Hingedly attached to bottom wall 13 by score lines 32 and 33 are lower inner flaps 34 and 35, respectively. Hingedly attached to rear wall 12 by score lines 36 and 37 are outer lower flaps 38 and 39, respectively. Flaps 38 and 39 are hingedly divided into panels 38*a*, 38*b*, 39*a*, and 39*b* by score lines 38*c* and 39*c*, respectively. Flaps 38 and 39 are divided from flaps 28 and 29 by slits 40 and 41, respectively. Flaps 34 and 35 are divided from flaps 38 and 39 by slits 42 and 43, respectively. Slits 42 and 43 include "U" shaped portions 42*a* and 43*a*, respectively defining tabs 44 and 45, respectively. "U" shaped slits 46 and 47 are sited proximate to score lines 36 and 37 and in position to cooperatively receive tabs 44 and 45, respectively on erection of the carton 2. "U" shaped slot 48 defining tab 49 is sited on front wall 10 so as to be cooperatively engageable with reverse tab 21 in securing the closure of carton 2.

To assemble carton 2 from blank 1, bottom wall 13 and front wall 10 may be folded upward along score lines 16 and 14, respectively, flaps 24, 25, 34 and 35 may be folded inward along score lines 22, 23, 32 and 33, respectively. A suitable adhesive may be applied to the upper or inner surface of glue panels 28*b*, 29*b*, 38*b* and 39*b* following which flaps 28, 29, 38 and 39 may be folded upward along score lines 26, 27, 36 and 37, respectively and adhered to the outer surface of flaps 24, 25, 34 and 35, respectively. Thus, flaps 24 and 25 cooperate with flaps 28 and 29 to form upper side walls 50 and 51, respectively and flaps 34 and 35 cooperate with flaps 38 and 39 to form lower side walls 52 and 53, respectively. During the process of assembling lower side walls 52 and 53, tab 44 engages in slot 46 and tab 45 engages in slot 47.

Carton 2 may be folded compactly for shipping and storage. The upper half may be folded substantially flat by folding the inside surface of front wall 10 toward the inside surface of top wall 11 along score line 14 while simultaneously folding flap 24 inward along score line 22, flap 25 inward along score line 23, flap 28 inward along score line 26 and flap 29 inward along score line 27. As panel 28*b* is secured to flap 24 when flap 28 is folded inward, it will fold at score line 28*c* permitting panels 28*a* and 28*b* to move in appropriate inward directions and permitting folding inward of upper side wall 50. Flap 29 will fold along score line 29*c* in similar fashion to permit inward folding of upper side wall 51. The lower half may be folded substantially flat in similar fashion by folding the inside surface of bottom wall 13 toward the inside surface of rear wall 12 along score line 16 while simultaneously folding flap 34 inward along score line 32, flap 35 inward along score line 33, flap 38 inward along score line 36 and flap 39 inward along score line 37. Flaps 38 and 39 will fold respectively to permit inward folding of lower side walls 52 and 53, respectively. To permit folding of lower side walls 52 and 53 tab 44 may be disengaged from slit 46 by flexing tongue 54 additionally defined by slits 55 and tab 45 may be disengaged from slit 47 by flexing tongue 56 additionally defined by slits 57.

Figure 3:
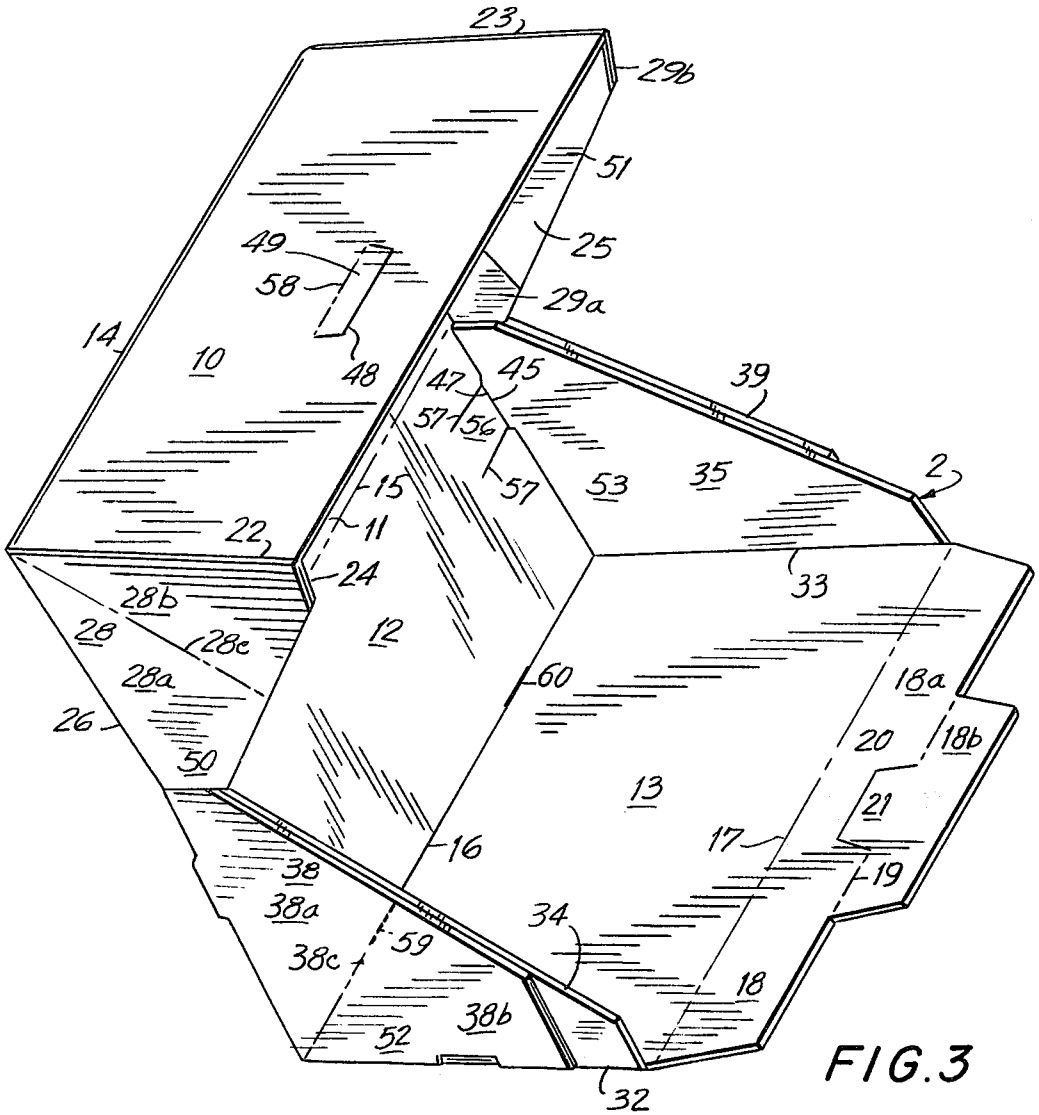
FIG. 3 is a perspective view of the carton of FIG. 2 erected and open for insertion of contents.
Figure 5:
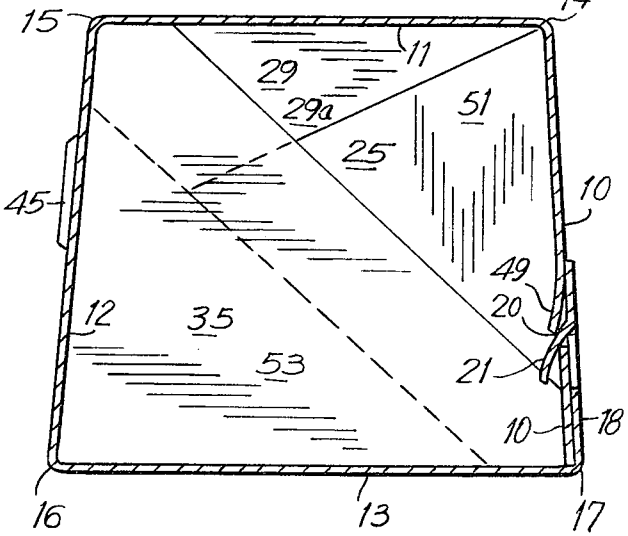
FIG. 5 is a horizontal view of a cross section along line 5—5 of FIG. 4
Figure 6:
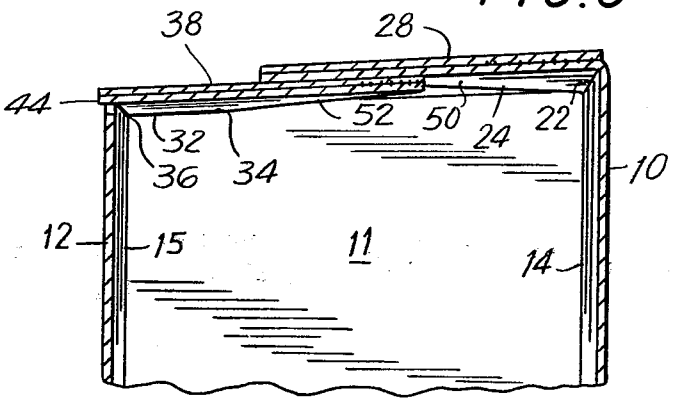
FIG. 6 is a partial cross section along line 6—6 of FIG. 4.
Figure 4:
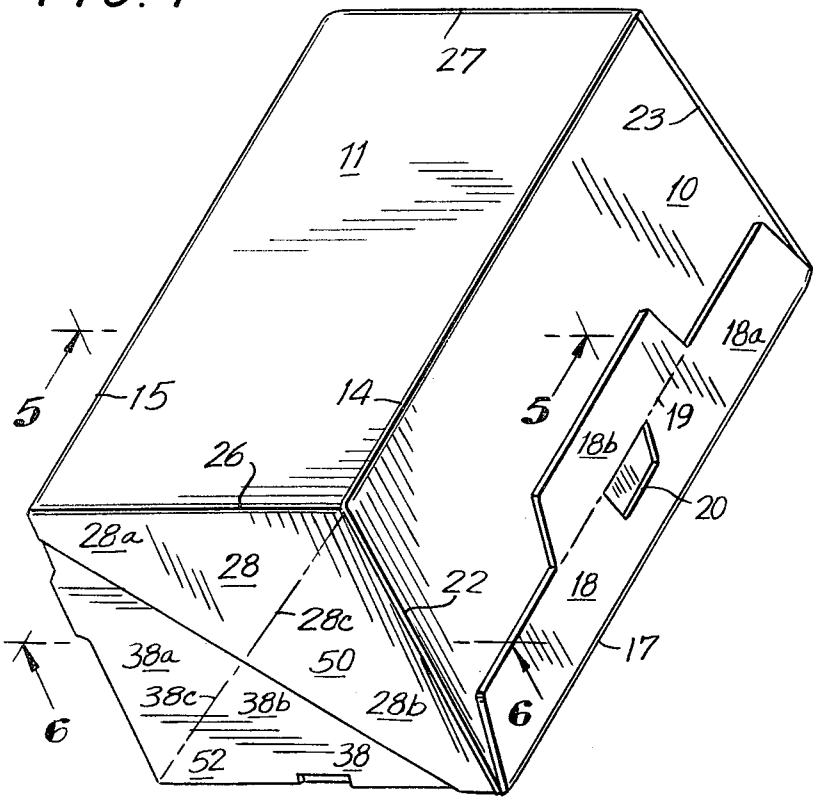
FIG. 4 is a perspective view of the carton of FIG. 3 closed and with the top portion secured.

Erection of the carton 2 so that contents may be inserted may be accomplished by reversing the above described folding sequence. Contents may normally be easily inserted when the carton is positioned as in FIG. 3 by simply placing the contents on the bottom wall.

Complete closure of open, erected carton 2, normally after insertion of contents, may be accomplished by folding, along score line 15, the upper half of the carton comprising upper side walls 50, 51, top wall 11 and front wall 10 over the lower half of the carton which comprises lower side walls 52 and 53, bottom wall 13 and rear wall 12 in such fashion that the lower edge of front wall 10 contacts bottom wall 13 at about score line 17, flap 18 extends beyond front wall 10, lower side wall 52 extends partially inside upper side wall 50 and lower side wall 53 extends partially inside upper side wall 51. Flap 18 may then be folded upward along score line 17 and reverse tab 21 inserted into slit 48. Insertion of tab 21 into slit 48 will result in deflection inward of tab 49 along score line 58.

Reopening of the carton 2 may be accomplished by releasing tab 21 from slit 48 conveniently by bending flap 18*b* outward along score line 19 and pulling outward to release tab 21 then unfolding the two halves of the carton along score line 15.

It will be noted that when erected, both the upper and lower halves of the carton have a "V" shaped cross section when viewed from an end.

It will also be noted that insertion of tabs 44 and 45 in slits 46 and 47 aids in supporting lower end walls 52 and 53, respectively in the erected position. The partial extension of lower end walls 52 and 53 inside upper end walls 50 and 51 upon closure of the carton aids in supporting upper end walls 50 and 51 in the erected position as well as providing for reduced access for contaminants such as dust and air borne dirt to the interior of the closed carton.

It will be obvious that when carton 2 is fully folded for storage and shipping tabs 44 and 45 may contact score line 16. It is preferred to provide cooperating slits 59 and 60 in score line 16 to permit tabs 44 and 45 to extend therethru to prevent damage or distortion of said tabs and permit easy folding and later erection.

The carton may be constructed from any convenient semi-rigid sheet material standard folding carton paper stock, bleached or unbleached, coated or uncoated, formed by fourdrinier or cylinder machines is convenient and preferred, although semi-rigid plastic sheet either foamed or non-foamed may be employed if desired.

It will be obvious to one of skill in the art that the relative sizes and proportions of the carton may vary widely from that illustrated while retaining the "V" shaped cross section of the upper and lower portions of the carton. For example, the almost square cross sectional configuration may be varied to provide a closed cross section approximating a rectangle in general. Such equivalents are contemplated herein and in the appended claims.

Similarly, it will be obvious that other locking features in addition to the particular reverse tab specifically illustrated may be substantial therefore and will be equivalents. Illustrative of these are arrow tabs and tuck closures. Such alternative locking features are contemplated as equivalent herein and in the appended claims.

The subject matter which applicant regards as his invention is particularly pointed out distinctly claimed as follows:

1. A folding carton consisting of (A) a lower portion having a substantially "V" shaped cross section comprising a bottom wall, a rear wall hingedly attached thereto, and two lower side walls hingedly attached to said bottom and rear walls; each of said side walls comprising an inner lower flap hingedly attached to said bottom wall and an outer lower flap hingedly attached to said rear wall, said outer lower flap being divided into substantially equal glue and non-glue panels by a fold line extending upwardly from the intersection of said outer lower flap and said bottom and rear walls, said glue panel being the panel relatively more remote from the line of attachment of said outer lower flap to said rear wall and said outer lower flap being secured to said inner lower flap only at said glue panel; said inner lower flap bearing a tab adapted to be cooperatively engaged in a slit sited about at the fold line connecting said rear wall and said outer lower flap; and (B) an upper portion having a substantially "V" shaped cross section, comprising a top wall hingedly attached to the rear wall of said lower portion, a front wall hingedly attached to said top wall and two upper side wall portions hingedly attached to said front and top wall, each of said upper side wall portions comprising an inner upper flap hingedly attached to said front wall and an outer upper flap hingedly attached to said top wall, said outer upper flap being divided into substantially equal glue and non-glue panels by a fold line extending downwardly from the intersection of said outer upper flap and said top and front walls, said glue panel being the panel relatively more remote from the line of attachment of said outer upper flap to said top wall and said outer upper flap being secured to said inner upper flap only at said glue panel; said lower side walls extending partially inside said upper side walls in the erected and closed carton; said bottom wall having a flap hingedly extending therefrom on the front edge thereof, said flap having a "U" shaped slit therein adapted to form a reverse tab cooperatively engageable in a corresponding slot in said front wall.

* * * * *